US007541988B2

(12) United States Patent
Sanelli et al.

(10) Patent No.: US 7,541,988 B2
(45) **Date of Patent: *Jun. 2, 2009**

(54) DUAL HEMISPHERE ANTENNA

(75) Inventors: John Sanelli, Seven Hills, OH (US); Stephen V. Saliga, Akron, OH (US); David M. Theobold, Akron, OH (US)

(73) Assignee: Cisco Technology, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 11/567,553

(22) Filed: Dec. 6, 2006

(65) Prior Publication Data

US 2007/0097012 A1 May 3, 2007

Related U.S. Application Data

(63) Continuation of application No. 10/686,233, filed on Oct. 15, 2003, now Pat. No. 7,202,824.

(51) Int. Cl.
*H01Q 1/24* (2006.01)

(52) U.S. Cl. ..... 343/702

(58) Field of Classification Search ..... 343/702, 343/893, 832–836, 841
See application file for complete search history.

(56) References Cited

U.S. PATENT DOCUMENTS

| | | | | |
|---|---|---|---|---|
| 6,127,987 | A * | 10/2000 | Maruyama et al. | 343/835 |
| 6,140,972 | A * | 10/2000 | Johnston et al. | 343/725 |
| 6,618,016 | B1 * | 9/2003 | Hannan et al. | 343/705 |
| 6,864,852 | B2 * | 3/2005 | Chiang et al. | 343/817 |
| 2003/0048226 | A1 * | 3/2003 | Gothard et al. | 343/700 MS |

* cited by examiner

*Primary Examiner*—Huedung Mancuso
(74) *Attorney, Agent, or Firm*—Tucker Ellis & West LLP

(57) ABSTRACT

A wireless device is disclosed, including an antenna system comprising one or more antenna elements for sending and receiving a wireless signal. One or more conductive members are included, having an edge displaced from and substantially directed toward the at least one antenna element, and cooperating therewith to establish a multiplicity of hemispherical beam patterns for a wireless signal. Embodiments with a multiplicity of antenna elements exhibit a high degree of isolation between said antenna elements.

14 Claims, 8 Drawing Sheets

DUAL HEMISPHERE ANTENNA

CROSS-REFERENCE TO RELATED APPLICATIONS

This application is a continuation of U.S. Application No. 10/686,233, filed on Oct. 15, 2003, now U.S. Pat. No. 7,202,824.

BACKGROUND

The present invention is directed to the field of wireless networking, with particular applicability to rollouts in which there is a large quantity of wireless traffic in a given operational area. It is becoming increasingly common to implement wireless local area networks (WLANs) in addition to or in place of traditional LANs. In a traditional LAN, each client device, e.g. a personal computer etc., requires a physical, hard-wired connection to the network. However, with a WLAN, each client device includes a wireless capability (such as an insertable, embedded card or fully integrated capability) for wirelessly communicating with the network via an access point (AP) that includes an antenna, a transceiver and a hard-wired connection to the network. In this way, users may carry their hand-held devices and laptop computers within a physical area and still maintain a network connection.

However, in "crowded" enterprise rollouts, it can be difficult for a large number of users to simultaneously access the network due to the contention-based protocol used. Accordingly, it has been contemplated that multiple wireless channels can be used for allowing user access. Three non-overlapping channels have been allocated in the 2.4 GHz band, and eleven channels in the 5 GHz band. Using multiple available channels, an AP may be implemented in a single-package topology that enables simultaneous transmission and reception on nearby frequency channels at the same interval in time. A problem inherent with such a topology is a high degree of self-interference between signals on adjacent channels, resulting in poor quality of service. It is thus desirable to provide signal isolation between each transceiver in the AP. Depending on the tranceiver architecture, there will be an additional antenna-to-antenna isolation requirement that must be met to achieve the overall required signal isolation.

A special problem arises when a multiplicity of antenna elements used to support a single unit, multichannel AP are in close proximity to each other and whose element-to-element isolation is low. The overall requirement is to cover a large (omnidirectional) area with all of the AP channels, either in concert or sectorially. Absorber materials are known for providing antenna isolation, but these materials are expensive, bulky, and otherwise unsuitable as the sole method for achieving the required isolation. Physical separation between the antennas is also a solution, however this would lead to a product that could not be neatly integrated into a single reasonably sized housing. This problem can be also addressed by the use of "smart" antennas, in which the antenna can be "steered" toward a particular client or group of clients to send and receive signals and yet maintain high isolation from other steered beams. Directional antennas with high front-to-back ratios (F/B ratio) can also be used in some applications, such as when a geometrically isolated area must be covered. However, a special case arises when a two channel system is desired. These might be two channels in the 2.4 GHz band or two channels in the 5 GHz band. In these situations, one desires a hemispherical radiation pattern so that the coverage area can be divided into two sectors. The isolation must still be high to allow simultaneous operation of those two transceivers. A novel solution to this special problem is disclosed herein.

OVERVIEW OF EXAMPLE EMBODIMENTS

In an example embodiment, there is described herein a dual hemisphere antenna. The dual hemisphere antenna comprising active antenna elements for sending and receiving a wireless signal At least one central passive conductive member is situated between the antenna elements. The passive conductive member edges are displaced from and substantially directed toward the active antenna elements, and cooperate to establish hemispherical beam patterns. Optimally, the active antenna elements are disposed respectively along the periphery of the at least one conductive member, and cooperating therewith to establish a respective plurality of hemispherical beam patterns. Optimally a first portion of the antenna elements are adapted to operate over a first wireless frequency band, and a second portion of antenna elements adapted to operate over a second wireless frequency band. Optimally, the first and second wireless frequency bands are 2.4 GHz and 5 GHz wireless bands.

In accordance with an example embodiment, there is described herein a wireless device. The wireless device comprises a radio transceiver comprising a plurality of radio components for processing a wireless signal. Pluralities of active antenna elements are used for sending and receiving a wireless signal. At least one central passive conductive member is situated between the plurality of antenna elements, having edges displaced from and substantially directed toward the plurality of active antenna elements, and cooperating to establish a plurality of hemispherical beam patterns for the wireless signal.

In accordance with an example embodiment, there is described herein a wireless device. The wireless device comprises a radio transceiver comprising a plurality of radio components for processing a wireless signal. Pluralities of active antenna elements are used for sending and receiving a wireless signal. At least one passive conductive member, having edges displaced from and substantially directed toward the plurality of active antenna elements that are shorter thane the respective edge of the conductive member, and cooperating to establish a plurality of hemispherical beam patterns for the wireless signal.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DESCRIPTION OF EXAMPLE EMBODIMENTS

Particular reference is now made to the figures, where it is understood that like reference numbers refer to like elements.

Figure 1A:
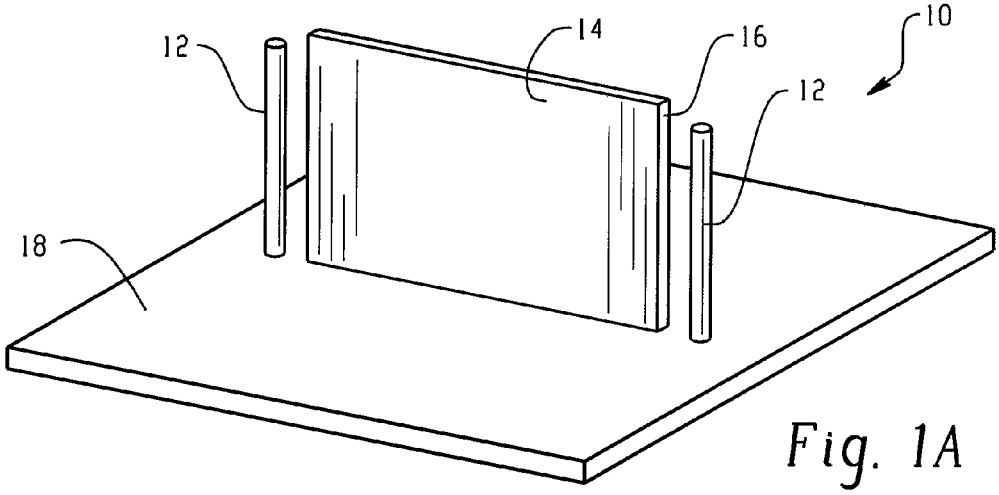
FIGS. 1A, 1B and 1C illustrate example embodiments of the present antenna system.

As shown in FIG. 1A, the present antenna system 10 includes one or more antenna elements 12 for sending and receiving a wireless signal. One or more conductive members 14 are provided, preferably in the form of metallic sheets or fins, having an edge 16 displaced from the antenna element 12. The edge 16 is substantially directed toward the antenna element 12. The antenna system 10 is a cooperative component of a radio transceiver including a plurality of radio components for processing a wireless signal, as will be set forth in detail below. It has been observed that a conductive member 14 and an antenna oriented in this manner cooperate in such a way as to establish a hemispherical beam pattern, as will also be set forth in greater detail below.

Applicants have discovered that metallic fins 14 configured with antennas 12 in the disclosed manner simultaneously provide signal isolation and a dual hemispherical radiation pattern for each antenna 12. It has been contemplated that the metallic fins 14 can be formed of brass having a thickness of about 5 mils and dimensions of 3 inches×4 inches at a nominal operating frequency of 2.4 GHz. Appropriate scaling is required for operation at other frequencies, inversely proportional to frequency. It is of course appreciated that any suitable metal or other conductor could be substituted for brass. The antennas 12 are preferably dipoles selected to provide a wide bandwidth with a small aperture and a suitable elemental radiation pattern.

Figure 1B:
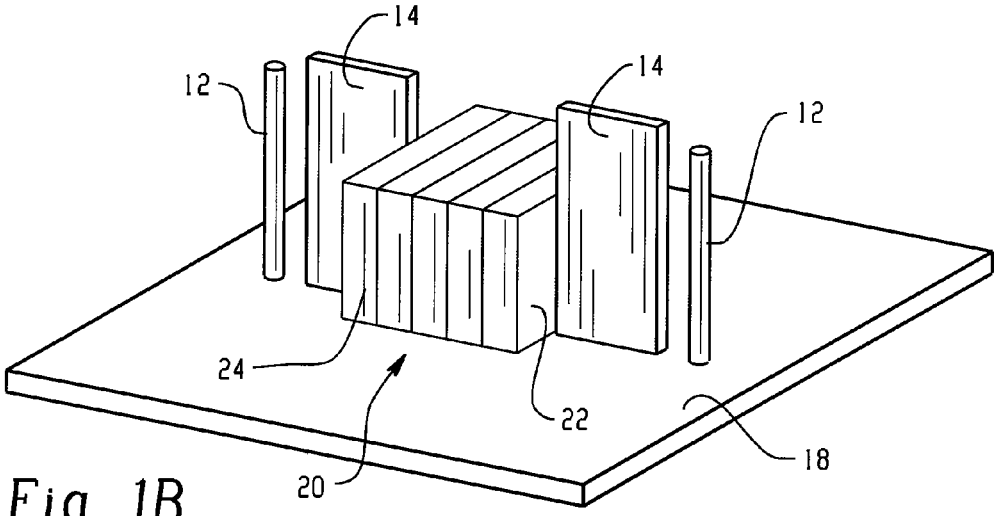

In an exemple embodiment shown in FIG. 1B, two dipole antennas 12 are used with a plurality of metallic fins 14 placed between the antennas, lying in the same plane as the antennas 12. A ground plane 18 may be optionally be included. In this exemple embodiment, a sandwich module 20 is provided for providing a further level of antenna isolation. The sandwich module 20 includes metal plates 22, preferably formed of brass, which substantially face the metal fins 14, preferably at a perpendicular angle. These plates 22 are preferably electrically separated from the fins 14, though they may optionally be in electrical contact. The sandwich module 20 also preferably includes a separation material 24, which is preferably an RF isolating foam such as AN-77 or another suitable type of material.

Figure 1C:
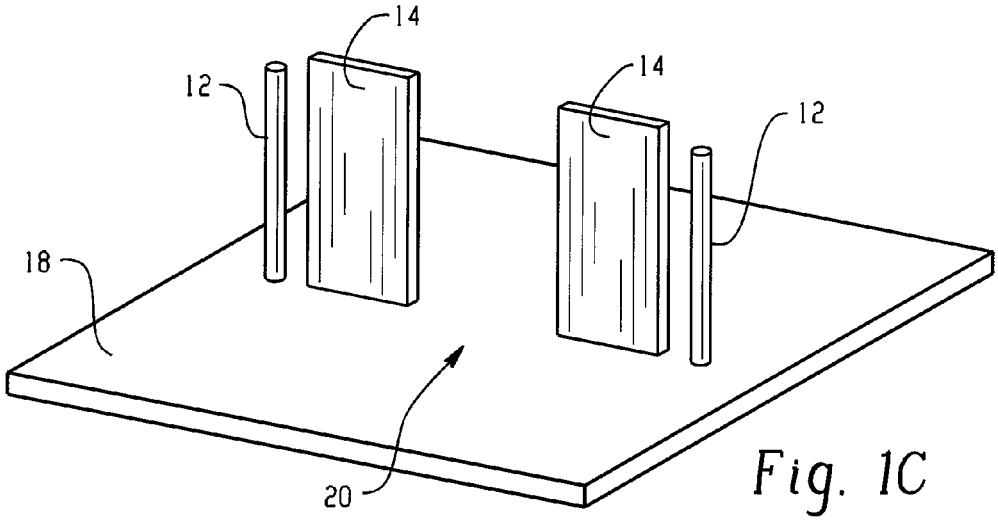

Various permutations of element size and orientation were discovered that result in varying degrees of isolation, as will be shown below in the discussion of the other embodiments. For example, as shown in FIG. 1C, the sandwich may alternatively be omitted; an embodiment in which no metal plates 22 or isolating foam is employed. In a further alternate embodiment, brass plates 22 alone may also be employed, without the isolating foam 24. In a further alternate embodiment, brass plates 22 may also be employed, with the isolating foam 24. Table 1 lists various isolation cases of selected permutations of the sandwich module.

TABLE 1

Isolation vs. Sandwich

| Quantity of Conductive Members 14 | Composition of Sandwich Module 20 | Isolation (dB) |
|---|---|---|
| None | Air | 22 |
| Two | Air | 45 |
| Two | Brass Sheets 22 | 51 |
| Two | Brass Sheets 22 and AN-77 24 | 59 |

Figure 5A:
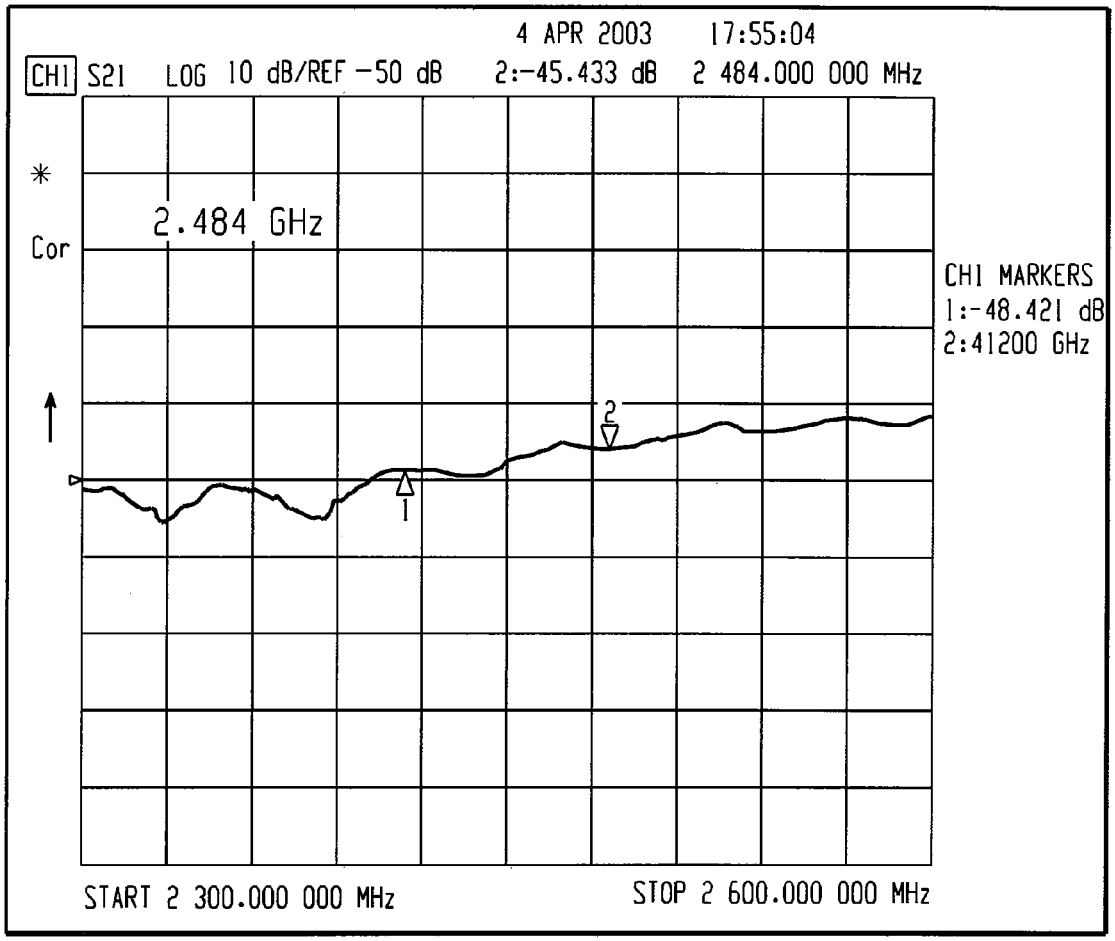
FIGS. 5A, 5B and 5C illustrate examples of various degrees of signal isolation between each antenna in a dual antenna embodiment.
Figure 5B:
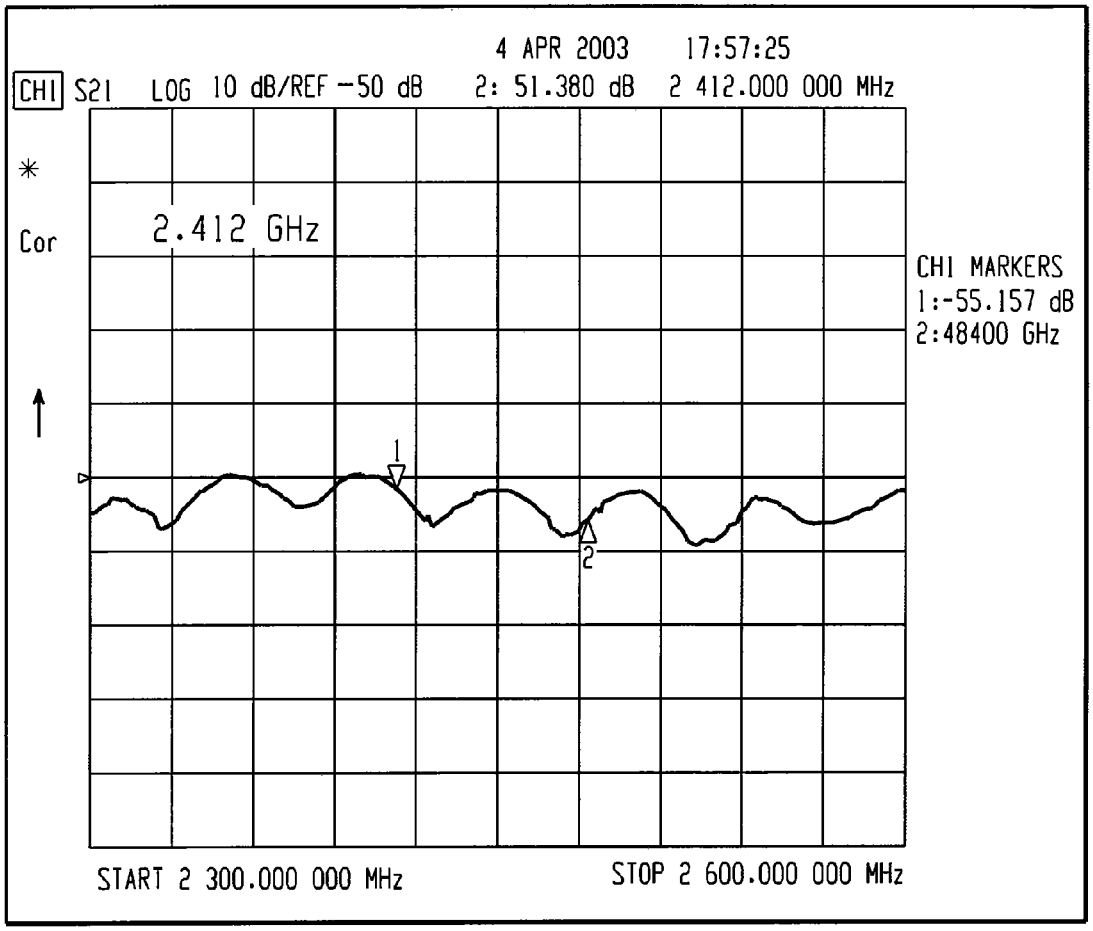
Figure 5C:
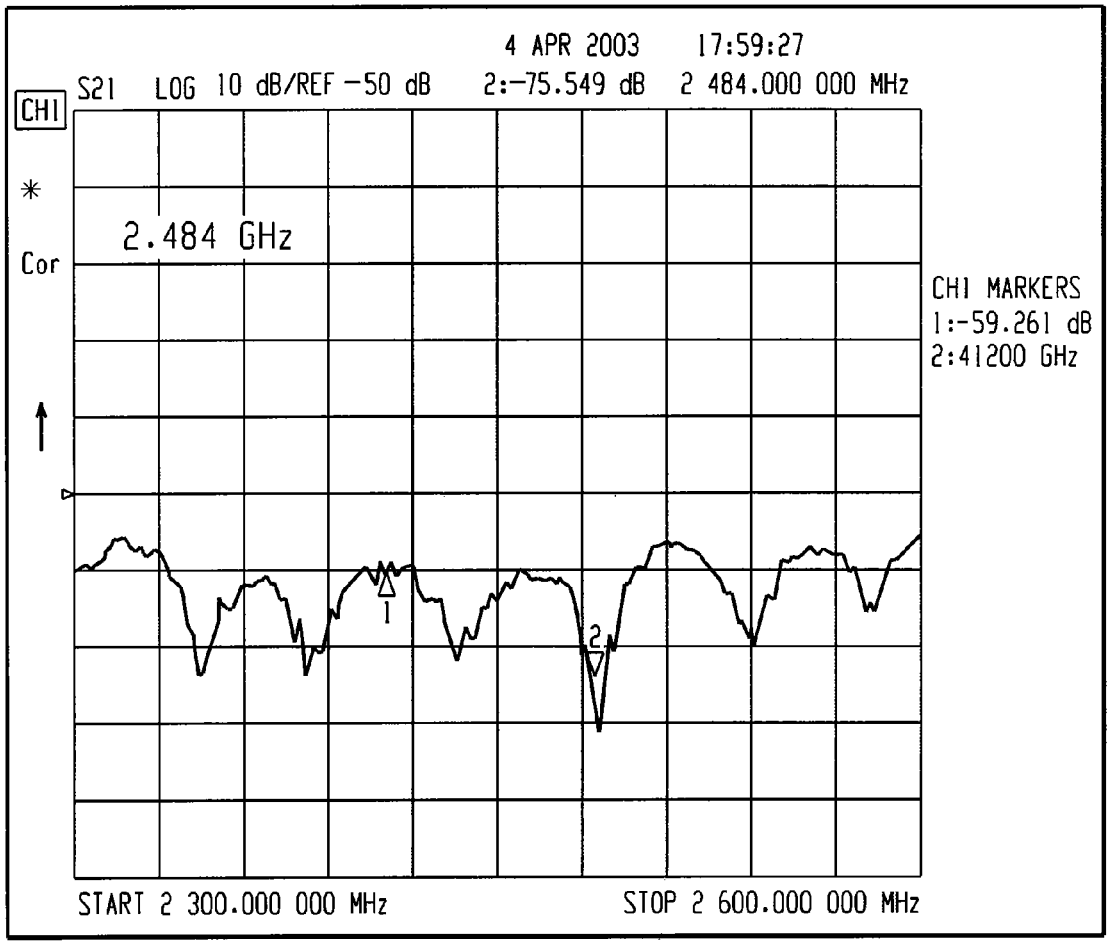

Because a dipole is an omni-directional radiating element, the isolation between two antennas is poor without any additional isolation element. For example, at one wavelength of separation (4.8" at 2450 MHz), 2 dipoles have only 22 dB of isolation. However, with the presence of two of the fins 14, an isolation of greater than 45 dB is obtained, as shown in FIG. 5A. However, with the presence of two fins 14 and a separation material 24 (brass sheets), an isolation of greater than 51 dB is obtained, as shown in FIG. 5B. However, with the presence of two fins 14 and a separation material 24 (brass sheets and isolating foam), an isolation greater than 59 dB is obtained, as shown in FIG. 5C. The embodiment of FIG. 1B provides signal isolation between the two dipole antennas of greater than 51 dB in the 2.4 GHz WLAN band, which is a standard band from 2412 to 2484 MHz, as shown in FIG. 5B.

Figure 6:
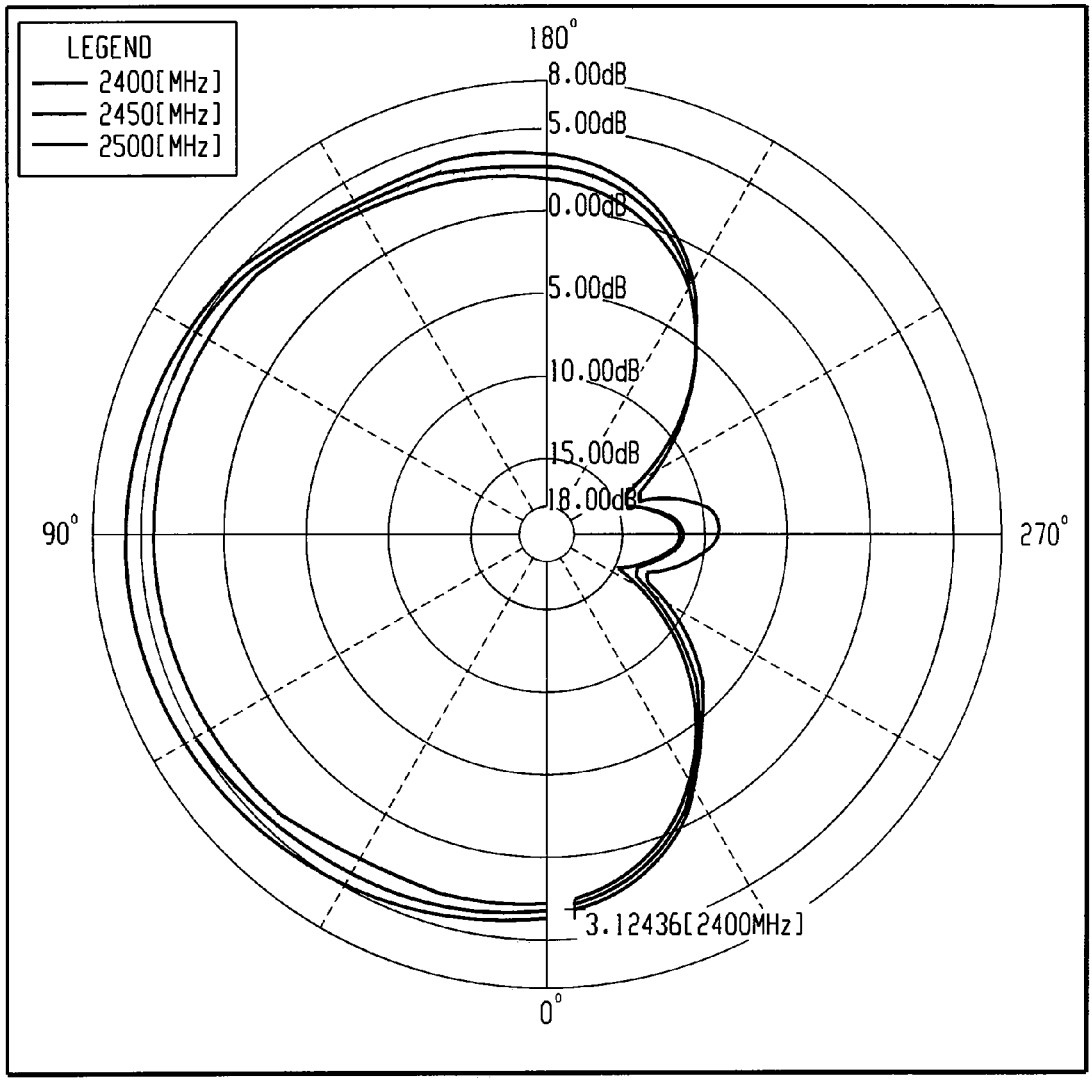
FIG. 6 illustrates an example antenna gain pattern for a single antenna in a present embodiment.

FIG. 6 illustrates the H-Plane radiation pattern of one hemisphere in the embodiment of FIG. 1B. A 3 dB beamwidth is measured in the H-Plane of about 186 degrees, which substantially demonstrates the desired characteristic of a hemispherical coverage antenna element. The resultant pattern demonstrates excellent symmetry and minimal variation over the frequencies of interest. A hemispherical radiation pattern results for each antenna element, thereby providing good radiated power at the points where the channels will overlap, thus minimizing pattern-to-pattern signal minima (or scalloping).

Figure 2:
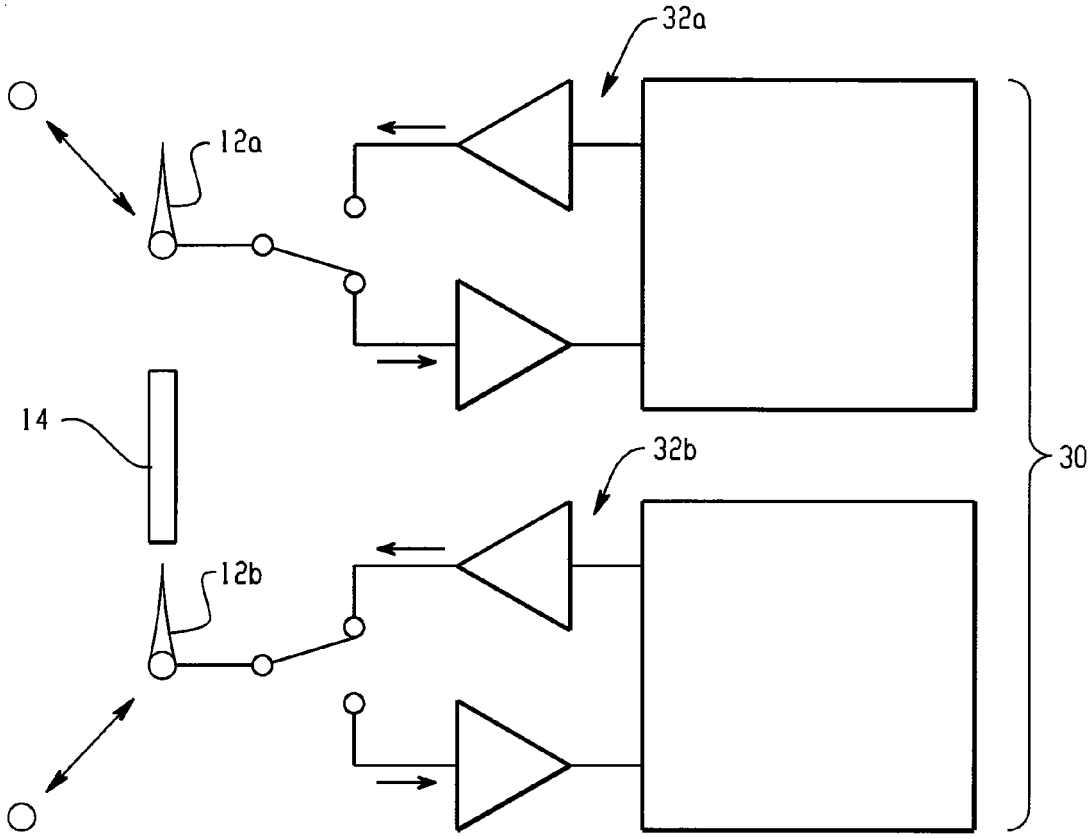
FIG. 2 illustrates an example operation of a wireless access point implemented with the present antenna system.
Figure 3A:
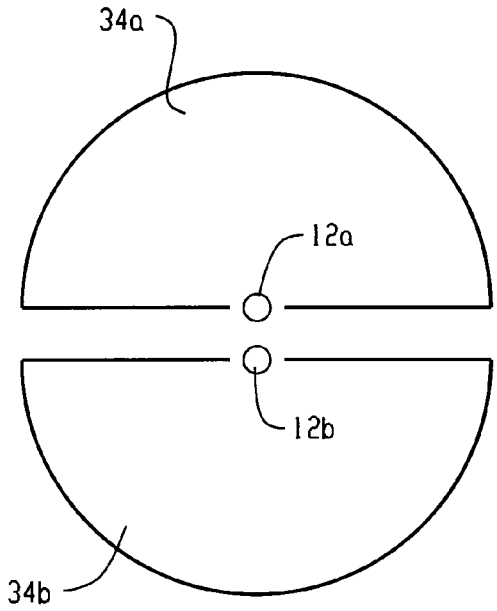
FIGS. 3A and 3B illustrate example antenna gain patterns obtainable with the present antenna system.
Figure 3B:
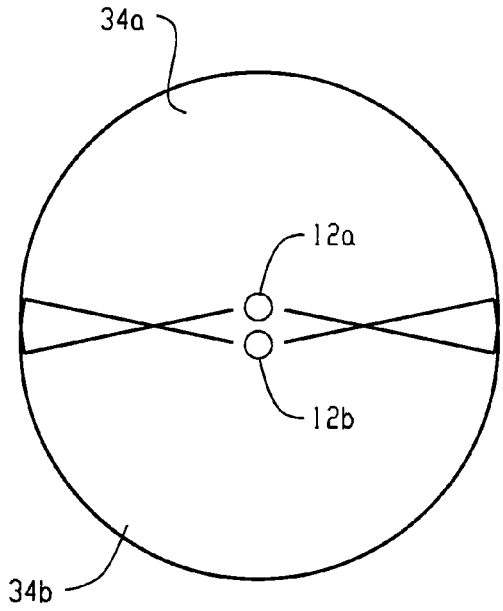

The hemispheric pattern and resulting high isolation obtained by the present arrangement enables a dual hemispherical antenna system in which two antenna elements 12*a*, 12*b* of FIG. 2 can be used to cooperate with the conductive member 14. In this way, as especially shown in FIG. 2, each antenna element 12*a*, 12*b* can communicate simultaneously on partially-interfering channels within the same wireless band. As shown in the FIG. 2, each antenna element 12*a*, 12*b* cooperates with one of a plurality of radio transceivers 30. Each transceiver includes a plurality of respective radio components 32*a*, 32*b* for processing a wireless signal. In this manner, one antenna 12*a* e.g. can transmit while the other antenna 12*b* receives on a different channel in the same band. As shown in FIG. 3A, each antenna 12*a*, and 12*b* would produce its own respective isolated beam pattern 34*a*, 34*b* such that a dual hemispheric beam pattern would ideally result with no coupling. However, in practice, as shown in FIG. 3B, the respective beam patterns 34*a*, 34*b* are closer to about 186 degrees, and so there is some overlap between the coverage areas of the antenna elements 12*a*, 12*b*. Though a minor amount of signal coupling may result in this overlap region, this is nevertheless a satisfactory outcome since it insures a full 360 degree field of coverage for wireless clients.

The benefits of the present system can be realized in a variety of configurations. In one embodiment, for example, a single antenna element 12 can be configured to cooperate with the conductive member 14. In a preferred embodiment, as particularly shown in FIGS. 1A, 1B, 1C inter alia, a pair of antenna elements 12 are provided, disposed respectively at opposite ends of the at least one conductive member, and cooperating therewith to establish a respective pair of hemispherical beam patterns.

Figure 4A:
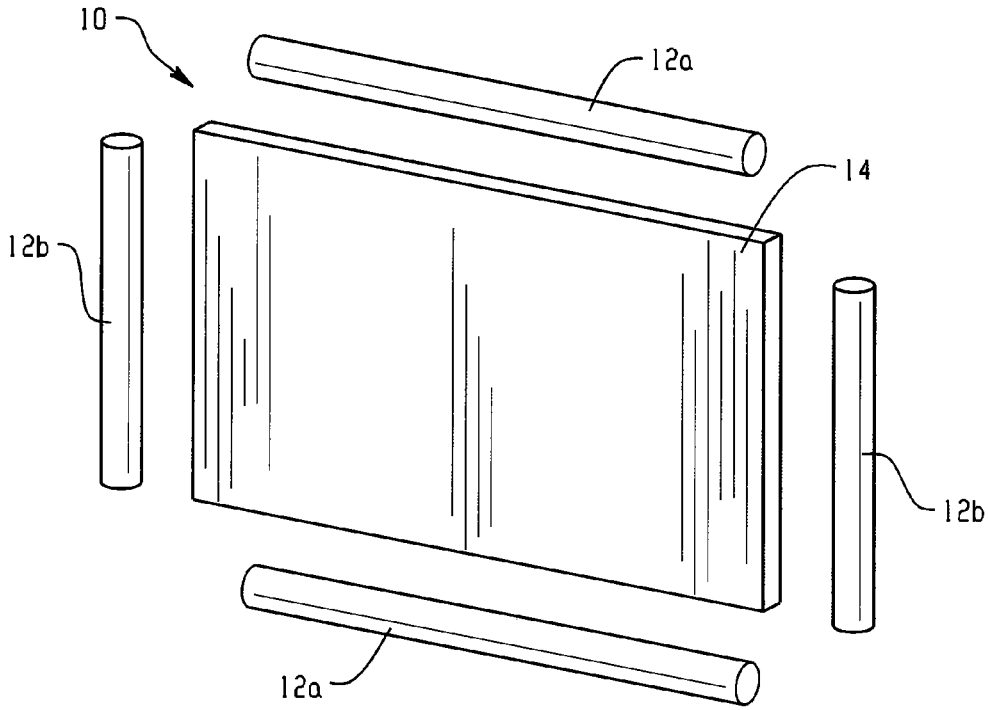
FIGS. 4A, 4B, 4C, 4D and 4E illustrate examples of various alternate embodiments of a conductive fin as used with the present antenna system.

As is shown in FIG. 4A, a plurality of antenna elements 12*a*, 12*b* can be provided, disposed respectively along the periphery the conductive member 14. These antenna elements 12 and the conductive member cooperate therewith to establish a respective plurality of hemispherical beam patterns. A portion of antenna elements 12*a*, 12*b* can be adapted to operate over one wireless frequency band, and another portion of antenna elements 12*a*, 12*b* can be adapted to operate over a second wireless frequency band. For example, in the four-antenna embodiment shown in FIG. 4A, the antenna elements 12*a* can be used to operate over the 2.4 GHz band and the other antenna elements 12*b* can operate over the 5 GHz wireless band. It should be understood that a peripheral arrangement is not limited to four antennas around a square conductive member. Any polygonal arrangement could be contemplated, such as hexagonal or octagonal, without departing from the invention. The isolation in these embodiments will differ from that example provided for the two-element configuration, depending upon the geometrical topology.

Figure 4B:
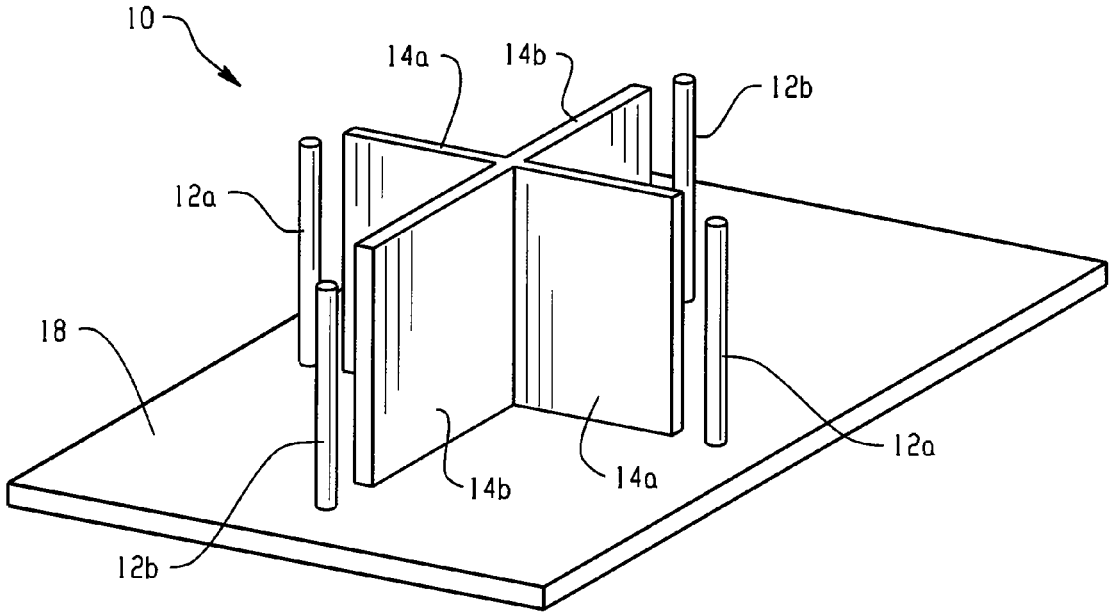

Another embodiment of the present antenna system 10 is shown in FIG. 4B. A plurality of conductive members 14*a*, 14*b* can be provided where each conductive member 14*a*, 14*b* is associated with one or more antenna elements 12*a*, 12*b*. The conductive members 14*a*, 14*b* are preferably discrete fins, oriented at a substantially perpendicular angle, where respective fins 14*a* are coplanar, and respective other fins 14*b* are also coplanar. Each conductive member 14*a*, 14*b* is preferably associated with a respective pair of antenna elements 12*a*, 12*b*, disposed at respective opposite ends of their respective conductive member 14*a*, 14*b*. The respective fins 14*a*, 14*b* are preferably not connected, intersected members, but these can be made connected and intersecting without departing from the invention. Also, further to the embodiment of FIG. 1B, this embodiment may be configured with a sandwich module, in which the metal plates for one set of antennas 12*a* form the fins 14*b* for the respective other set of antennas 14*b*.

Preferably, the pair of antenna elements 12*a* associated with a first conductive member 14*a* is adapted to operate on a first wireless frequency band. The pair of antenna elements 12*b* associated with a second conductive member 14*b* is adapted to operate on a second wireless frequency band. The respective wireless frequency bands can be 2.4 GHz and 5 GHz wireless bands. However, it should be understood that this embodiment is not limited to only two bands. The antenna system 10 can include a number of conductive members arranged in a "star" type configuration, with respective pairs of antenna elements, all without departing from the invention.

Figure 4C:
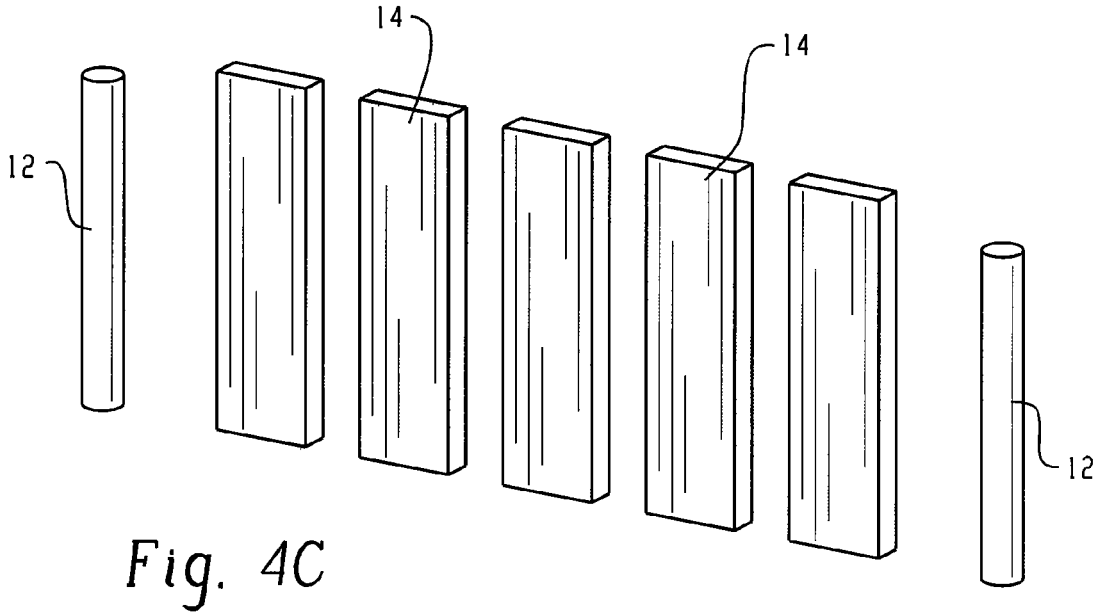
Figure 4D:
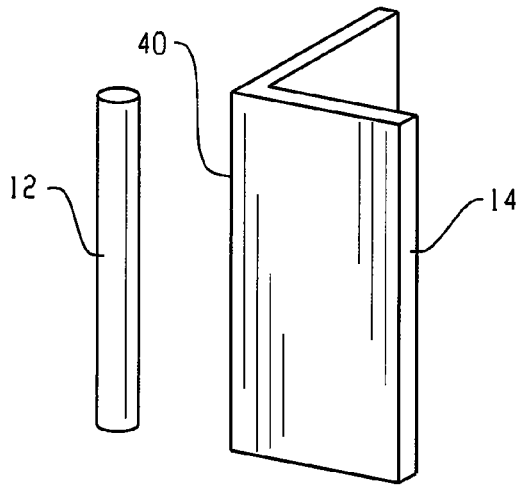
Figure 4E:
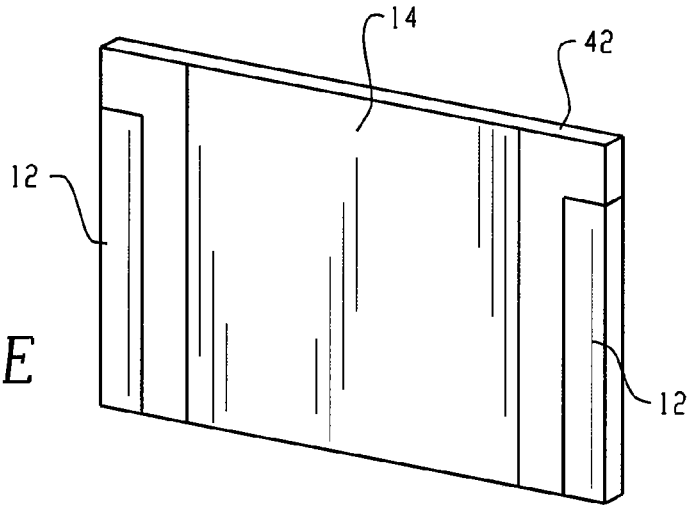

In the preferred embodiment, the conductive member 14 is two substantially coplanar elements that are coplanar with the one or more antenna elements 12. However, as shown in FIG. 4C, a plurality of planar elements 14 can be provided, substantially coplanar with the antenna element 12. Alternatively, the conductive member 14 can be a substantially contoured member. As shown in FIG. 4D, the substantially contoured conductive member 14 can be an angled member having a vertex edge 40 substantially directed toward the antenna element 12. In general, it has been observed that the isolation and hemispheric beam pattern are obtained by having a sharply defined edge 16 directed toward the antenna element 12. Also, the edge 16 should be parallel with the dipole antenna element 12. In the preferred embodiment, as indicated above, the antenna element 12 is a dipole antenna and the conductive member 14 is one or more discrete components. However, in an alternate embodiment shown in FIG. 4E, one or more antenna elements 12 and conductive members 14 can be formed on a single piece of circuit board material 42, and manufactured thereon by typical processes of circuit board manufacture, e.g. acid etching or machining, etc. In any event, it has been observed that the desirable isolation and beam pattern were obtained in embodiments where the antenna element 12 is shorter that the respective edge 16 of the conductive member 14.

The present dual hemisphere antenna arrangement provides a 180-degree sector antenna implementation with low "scalloping", greater than the gain of an omnidirectional antenna and at least 51 dB of isolation (so as to keep the transmit signal out of the receiver alternate channel). Also, the materials used in the present embodiments are inexpensive and the topology would be straightforward to manufacture. Thus, the present system achieves superior results over previous-type systems with an inexpensive solution that simultaneously has 180° beamwidth and 51 dB of isolation. This is an improvement over known-type sectorized antennas, such as are common in the cellular world, that rely on physical separation, polarization diversity, and expensive diplexers to achieve isolation.

The present conductive member 14 is essentially a reflector screen that provides a high degree of isolation between two dipole antennas, simultaneously yielding a hemispherical radiation pattern in the H-plane. The solution does not require the use of traditional frequency selective surfaces where the benefit might be only 6 dB per octave per surface to get the 51 dB+ isolation. Similarly, the present invention does not require polarization screens since the two antenna elements 12 operate at the same polarization, and a slant polarization would result in a 4 dB penalty of forward gain against the link budget. Finally, the present results are obtained in a compact package which would be very desireable from a consumer marketing standpoint.

As described hereinabove, the present invention solves many problems associated with previous type systems. However, it will be appreciated that various changes in the details, materials and arrangements of parts which have been herein described and illustrated in order to explain the nature of the invention may be made by those skilled in the area within the principle and scope of the invention will be expressed in the appended claims.

We claim:

1. An antenna system comprising:

a plurality of antenna elements for sending and receiving a wireless signal; and at least one metallic sheet situated between the plurality of antenna elements, the metallic sheet having edges displaced from and substantially directed toward the plurality of active antenna elements, and cooperating therewith to establish a plurality of hemispherical beam patterns.

2. The antenna system of claim 1, wherein the plurality of antenna elements comprises a pair of antenna elements, disposed respectively at opposite ends of the at least one metallic sheet, and cooperating therewith to establish a respective pair of hemispherical beam patterns.

3. The antenna system of claim 1, wherein the plurality of active antenna elements are disposed respectively along the periphery of the at least one metallic sheet, and cooperating therewith to establish a respective plurality of hemispherical beam patterns.

4. The antenna system of claim 3, wherein a first pair of antenna elements are adapted to operate over a first wireless frequency band, and wherein a second pair of antenna elements are adapted to operate over a second wireless frequency band.

5. The antenna system of claim 4, wherein the first and second wireless frequency bands are 2.4 GHz and 5 GHz wireless bands.

6. The antenna system of claim 1, wherein the at least one of the plurality of antenna elements is a dipole antenna.

7. The antenna system of claim 1, wherein the plurality of antenna elements and at least one metallic sheet are formed on a single piece of circuit board material.

8. A wireless device comprising:

a radio transceiver comprising a plurality of radio components for processing a wireless signal;

a plurality of antenna elements for sending and receiving a wireless signal; and at least one metallic sheet situated between the plurality of antenna elements, the at least one metallic sheet having edges displaced from and substantially directed toward the plurality of active antenna elements, and cooperating therewith to establish a plurality of hemispherical beam patterns for the wireless signal.

9. The wireless device of claim 8, wherein the plurality of antenna elements comprises a pair of antenna elements, disposed respectively at opposite ends of the at least one metallic sheet, and cooperating therewith to establish a respective pair of hemispherical beam patterns.

10. The wireless device of claim 8, wherein the plurality of active antenna elements are disposed respectively along the periphery of the at least one metallic sheet, and cooperating therewith to establish a respective plurality of hemispherical beam patterns.

11. The wireless device of claim 10, wherein a first group of antenna elements are adapted to operate over a first wireless frequency band, and wherein a second group of antenna elements are adapted to operate over a second wireless frequency band.

12. The wireless device of claim 10, wherein the first and second wireless frequency bands are 2.4 GHz and 5 GHz wireless bands.

13. The wireless device of claim 8, wherein the plurality of antenna elements are dipole antennas.

14. The wireless device of claim 8, wherein the plurality of antenna elements and the at least one metallic sheet are formed on a single piece of circuit board material.

* * * * *